US008376523B2

(12) United States Patent
Guan et al.

(10) Patent No.: US 8,376,523 B2
(45) Date of Patent: Feb. 19, 2013

(54) CAPPING LAYER FOR INSULATOR IN MICRO-FLUID EJECTION HEADS

(75) Inventors: Yimin Guan, Lexington, KY (US); Burton Joyner, II, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 380 days.

(21) Appl. No.: 12/764,357

(22) Filed: Apr. 21, 2010

(65) Prior Publication Data

US 2011/0261115 A1 Oct. 27, 2011

(51) Int. Cl.
*B41J 2/05* (2006.01)

(52) U.S. Cl. ..... 347/61

(58) Field of Classification Search ..... 347/61
See application file for complete search history.

(56) References Cited

U.S. PATENT DOCUMENTS

| | | | | |
|---|---|---|---|---|
| 4,719,477 | A * | 1/1988 | Hess | 347/59 |
| 6,086,187 | A | 7/2000 | Hattori et al. | |
| 7,390,078 | B2 | 6/2008 | Bell et al. | |
| 2008/0079778 | A1 * | 4/2008 | Cornell et al. | 347/55 |

FOREIGN PATENT DOCUMENTS

WO WO/2009/150021 A2 12/2009

OTHER PUBLICATIONS

Abbe T. Kohl, et al., "Low k, Porous Methyl Silsesquioxane and Spin-On-Glass", Electrochemical and Solid-State Letters, 2 (2) 77-79 (1999).

* cited by examiner

*Primary Examiner* — Jerry Rahll

(57) ABSTRACT

A micro-fluid ejection head has a resistor layer defining a heater element. An insulative layer underlies the heater element and a capping layer on the insulative layer substantially prevents ion mobility between the resistor and insulative layers. Resistance stability of the heater has been shown improved as has adhesion of the heater to the insulator. Representative layers include insulation of methyl silesquioxane (MSQ) in a thickness of about 5000 Angstroms or more, while the cap is a silicon nitride in a thickness of about 2000 Angstroms or less. Other capping layers include silicon carbide, silicon oxide or dielectrics. The resistor layer typifies TaAlN in a thickness of about 350 Angstroms, including overlying anode and cathode conductors that define the heater. Coating layers are also disclosed as are thermal barrier layers.

7 Claims, 9 Drawing Sheets

CAPPING LAYER FOR INSULATOR IN MICRO-FLUID EJECTION HEADS

FIELD OF THE INVENTION

The present invention relates to micro-fluid ejection heads, such as inkjet printer actuation devices. More particularly, although not exclusively, it relates to insulating the devices to improve energy efficiency, including capping layers to stabilize resistivity.

BACKGROUND OF THE INVENTION

The art of printing images with micro-fluid technology is relatively well known. Familiar devices include fax machines, all-in-ones, inkjet printers, and graphics plotters, to name a few. Conventionally, an ejection head in an inkjet printer includes access to a local or remote supply of ink, a heater chip, a nozzle plate, and an input/output connector, such as a tape automated bond (TAB) circuit. The TAB circuit electrically connects the heater chip to the printer. The heater chip typifies thin film resistors or heaters fabricated by growing, forming, depositing, patterning and etching various layers on a substrate, such as a silicon wafer. One or more ink vias cut or etched through a thickness of the wafer serve to fluidly connect the ink to an individual resistive heater. To print or emit a single ink drop, a heater is uniquely addressed with a small amount of current from adjacent electrodes. The current causes heating of a small volume of ink which vaporizes in a local ink chamber. The ink ejects through the nozzle plate toward a print medium.

Thin films overlying a resistor layer traditionally include coating layers, such as silicon nitride (SiN) and tantalum (Ta) for reasons relating to passivation and ink cavitation protection. Underneath the resistor layer, a thermal barrier layer exists above the substrate. The oxide functions to prevent energy from the heaters from migrating into the substrate. While the design has proved adequate over the years, significant heat absorption from the heaters still remains in modern designs which keeps low the thermal efficiency of the micro-fluid ejection head. More recently, artisans have suggested bolstering the barrier layer with insulative materials, such as methyl silesquioxane (MSQ). Other layers are suggested in U.S. Pat. No. 7,390,078, incorporated herein.

During recent wafer qualification testing, however, the inventors have observed that direct contact between the MSQ and the resistor layer results in resistance instability over a long term life of the head. Particularly, the inventors have seen that resistance stability changes greatly over the course of tiring a printhead with substantial changes occurring around the five millionth firing. As is seen in FIG. 4, resistance instability 400 results in more than 30.0% change when traditional stability levels should range between 0 to 5.0% $\Delta R/R_i$.

Accordingly, a need exists to significantly improve stability of heater resistance. Solutions, however, should only minimally affect thermal impedance. Additional benefits and alternatives are also sought when devising such solutions.

SUMMARY OF THE INVENTION

The above-mentioned and other problems become solved by applying a capping layer to the insulators in micro-fluid ejection heads. Broadly, the insulator resides on the substrate between an oxide barrier layer and the resistor layer and a capping layer covers the insulator. In one design, the insulator embodies methyl silesquioxane (MSQ) while the cap is silicon nitride (SiN). Their thicknesses range from 5000-6000 Angstroms and from a few Angstroms to about 2000 Angstroms, respectively. It has been shown that such a design not only maintains thermal stability between 0 to 5.0% $\Delta R/R_i$ over a lifetime of firing, but also significantly improves adhesion between the MSQ and the resistor layer.

In still other designs, the capping layer can typify silicon carbide, silicon oxide or other dielectric materials. Alternatively, or in addition, plasma treatments are applied to the insulator layer to passivate the surface and seal off its pores. Contemplated treatments include $H_2$, $NH_3$, $N_2O$ and $O_2$. Printheads containing the ejection heads and printers containing the printhead are also disclosed.

These and other embodiments will be set forth in the description below. Their advantages and features will become readily apparent to skilled artisans. The claims set forth particular limitations.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE ILLUSTRATED EMBODIMENTS

In the following detailed description, reference is made to the accompanying drawings where like numerals represent like details. The embodiments are described in sufficient detail to enable those skilled in the art to practice the invention. It is to be understood that other embodiments may be utilized and that process, electrical, and mechanical changes, etc., may be made without departing from the scope of the invention. Also, the term wafer or substrate includes any base semiconductor structure such as silicon-on-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures hereafter devised or already known in the art. The following detailed description, therefore, is not to be taken in a limiting sense and the scope of the invention is defined only by the appended claims and their equivalents. In accordance with the present invention, methods and apparatus describe a cap for an insulator in a micro-fluid ejection head, such as an inkjet printhead.

Figure 1:
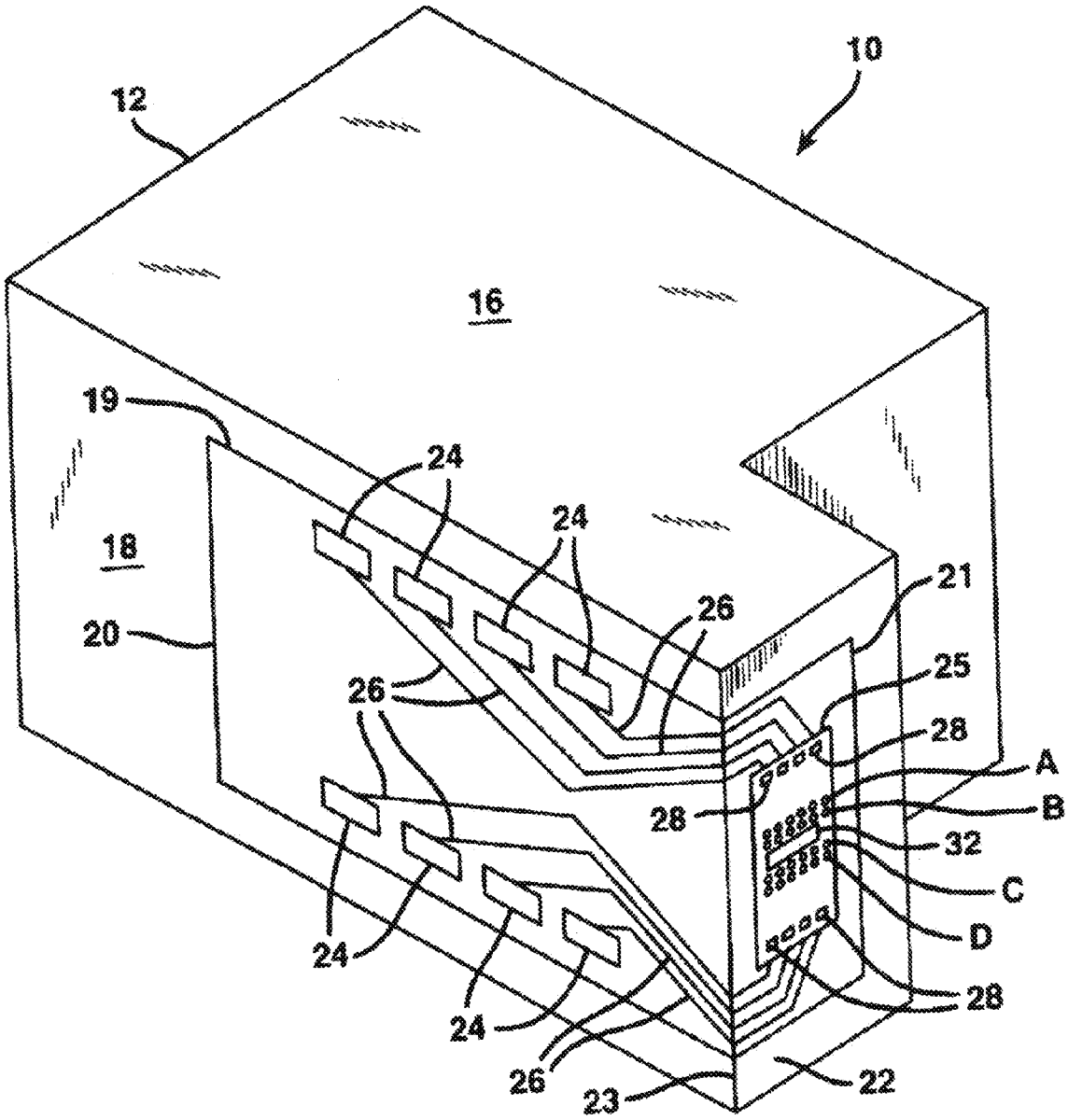
FIG. 1 is a perspective view in accordance with the teachings of the present invention of an inkjet printhead having an ejection head.

With reference to FIG. 1, an inkjet printhead is shown generally as 10. It includes a housing 12 whose shape varies with the external device that carries it. It has at least one internal compartment 16 for holding an initial and/or refillable supply of ink. In one embodiment, the compartment is a single chamber holding a supply of black ink, photo ink, cyan ink, magenta ink or yellow ink. In other embodiments, the compartment is multi-sectioned holding initial supplies of three inks, or more. Also, the compartment 16 is shown locally integrated within the housing, but skilled artisans will appreciate it can alternatively attach to a remote source of ink and receive supply from a tube, for example.

At surface 18, a portion 19 of a flexible circuit is adhered to the housing, especially a tape automated bond (TAB) circuit 20. At surface 22, the other portion 21 is adhered. In this way, two surfaces can be perpendicularly arranged relative one another (about an edge 23) to orient surface 22 toward a print medium during use while orienting surface 18 toward corresponding electrical connectors in an external device. Also, the TAB circuit supports a plurality of input/output (I/O) connectors 24 for electrically connecting a heater chip 25 to the external device, such as a printer, fax machine, copier, photoprinter, plotter, all-in-one, etc. Between the I/O connectors and the heater chip, pluralities of electrical conductors 26 serve to electrically short the connectors 24 to the input terminals (bond pads 28) of the heater chip 25. In composition, the TAB circuit typifies a polyimide material, while the electrical conductors and connectors comprise copper or other conductive metals. (For simplicity, FIG. 1 only shows eight I/O connectors 24, eight electrical conductors 26 and eight bond pads 28, but present day printheads have larger quantities and any number is embraced herein. Also, skilled artisans should appreciate that while such numbers of connectors, conductors and bond pads are equal to one another, actual printheads may have unequal numbers.)

At element 32, the heater chip 25 contains at least one ink via that fluidly connects to a supply of ink associated with the housing. To form the vias, many processes are known that cut or etch through a thickness of the heater chip. Some preferred processes include grit blasting or etching, such as wet, dry, reactive-ion-etching, deep reactive-ion-etching, or other. As shown, the heater chip contains four columns (column A-column D) of fluid firing elements or heaters (six circles) but actual practice may include several hundred or thousand, or more. Vertically adjacent ones of the fluid firing elements may also have a lateral spacing gap (not shown). In vertical pitch, the fluid firing elements have spacing comparable to the dots-per-inch resolution of an attendant printer. Some examples include spacing of $1/300^{th}$, $1/600^{th}$, $1/1200^{th}$, $1/2400^{th}$ or other of an inch alone the longitudinal extent of the via.

Figure 2:
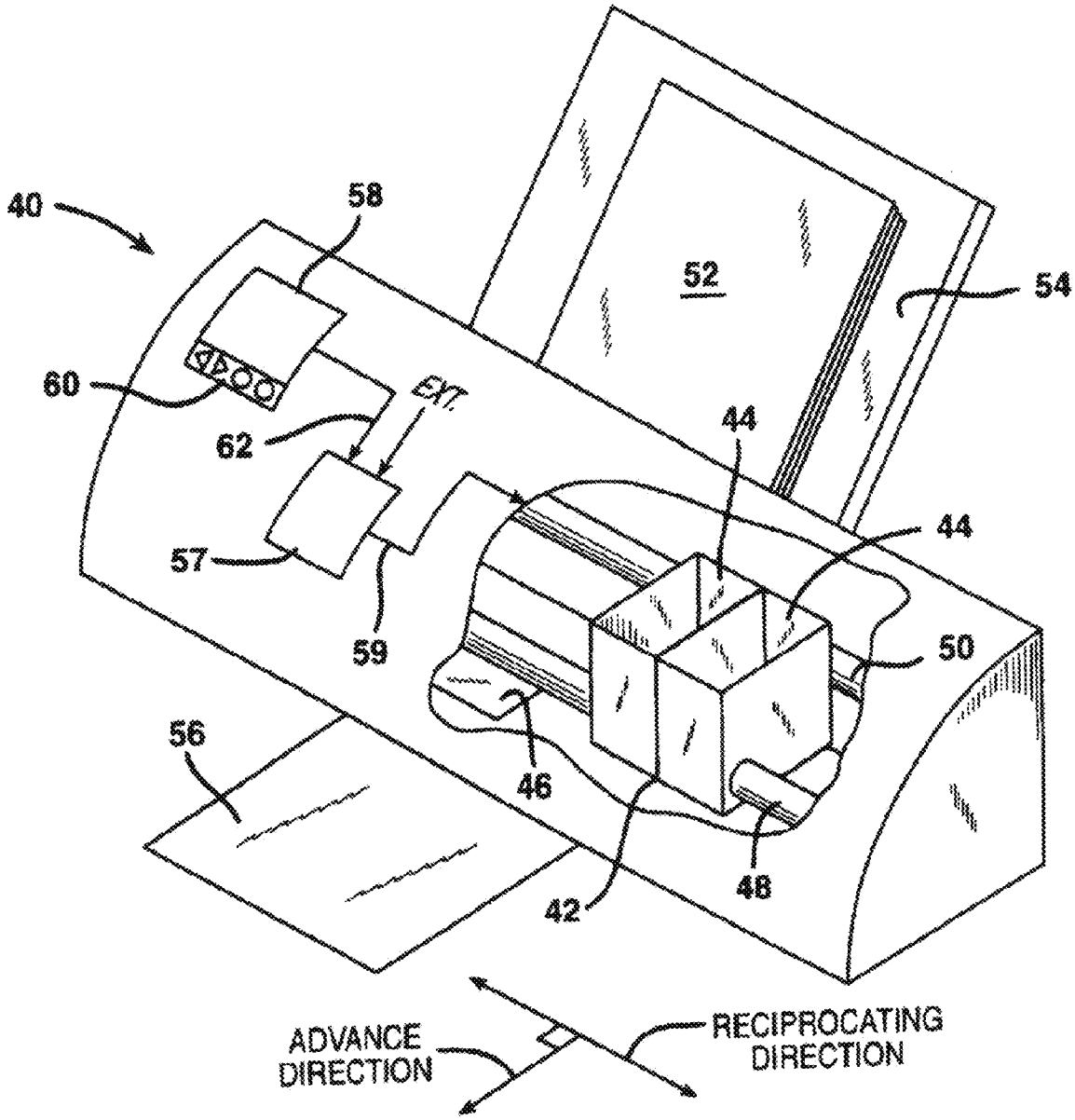
FIG. 2 is a perspective view in accordance with the teachings of the present invention of an inkjet printer for containing the inkjet printhead.

With reference to FIG. 2, an external device in the form of an inkjet printer contains the printhead during use. It is shown generally as 40. It includes a carriage 42 with a plurality of slots 44 for containing one or more printheads. The carriage 42 reciprocates in accordance with an output 59 of a controller 57. It moves along a shaft 48 above a print zone 46 by a motive force supplied to a drive belt 50 as is well known. The reciprocation occurs relative to a print medium, such as a sheet of paper 52 that advances in the printer 40 along a paper path from an input tray 54, through the print zone 46, to an output tray 56. While in the print zone, the carriage moves laterally in the direction indicated as Reciprocating. It is generally perpendicularly to the Advance Direction of the paper. Ink drops from compartment 16 (FIG. 1) are caused to eject from the heater chip 25 at such times pursuant to commands of a printer microprocessor or other controller 57. The timing of the ink drop emissions corresponds to a pattern of pixels of the image being printed. Often times, the patterns are generated in devices electrically connected to the controller 57 (via Ext. input) that reside external to the printer. They include, but are not limited to, a computer, a scanner, a camera, a visual display unit, a personal data assistant, or other. A control panel 58, having user selection interface 60, also accompanies many printers as input 62 to the controller 57 to provide additional robustness.

Figure 3:
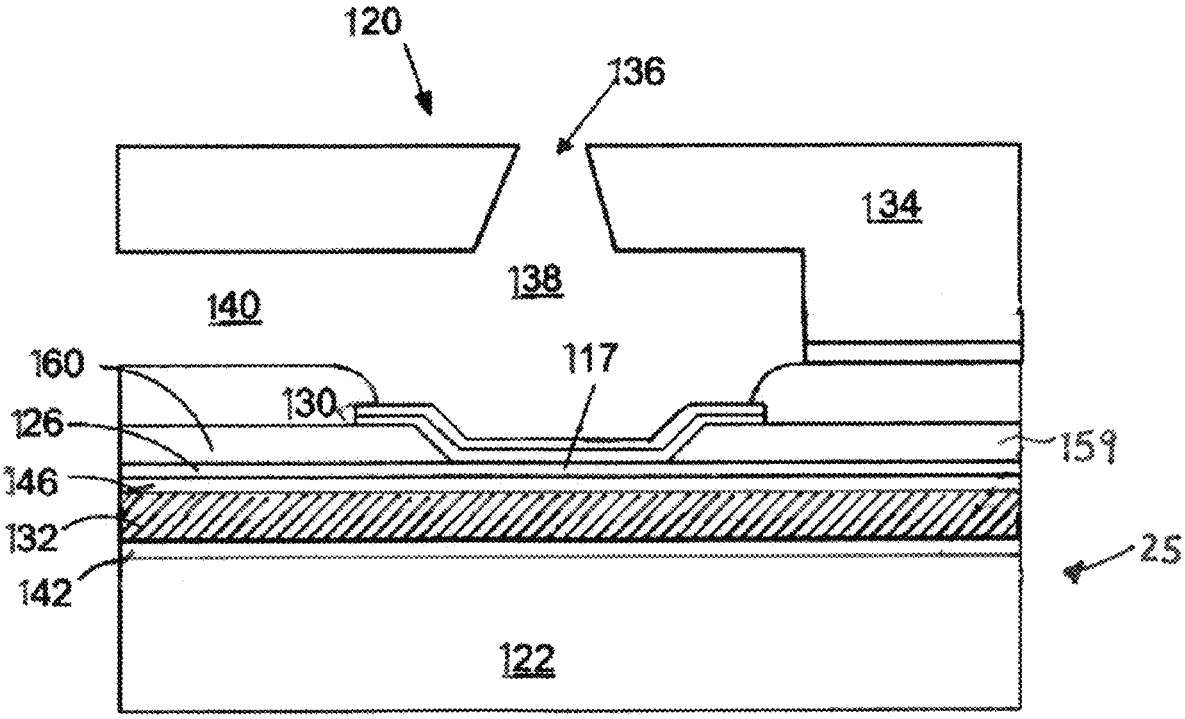
FIG. 3 is a diagrammatic view in accordance with the teachings of the present invention of an ejection head showing its relative layers.

With reference to FIG. 3, the fluid firing elements 117 (e.g., the circles in columns A-D, FIG. 1) are uniquely addressed with a small amount of current to rapidly heat a small volume of fluid (ink). The fluid vaporizes in a local fluid chamber 138 between the heater and nozzle plate 134 and ejects through the nozzle hole 136 toward the paper. The fluid is re-supplied from a fluid supply channel 140. Also, the fire pulse required to emit such drops embodies a single or a split firing pulse, or other, and is received at the heater chip 25 on an input terminal (e.g., bond pad 28, FIG. 1). It is signaled by way of addressing and ground (anode and cathode) electrodes 159, 160 from the input terminal to one or many of the fluid firing elements.

With continued reference to FIG. 3, the heater chip is a substrate having been processed through a series of growth, deposition, masking, patterning, photolithography, and/or etching or other processing steps. In a representative embodiment, the chip includes: a substrate 122; a thermal barrier layer 142; an insulative layer 132; a layer 146 for capping the insulative layers; a resistor layer 126; a conductor layer 159, 160 (bifurcated into positive and negative electrode sections, i.e., anode and cathode, defining the heater element 117) to heat the resistor layer through thermal conductivity during use; and one or more coating layers 130.

In various embodiments, the thin film layers become formed by any of a variety of chemical vapor depositions (CVD), physical vapor depositions (PVD), epitaxy, ion beam deposition, evaporation, sputtering or other similarly known or later developed techniques. Preferred CVD techniques include low pressure (LP), atmospheric pressure (AP), plasma enhanced (PE), high density plasma (HDP) or other. Preferred etching techniques include any variety of wet or dry etches, reactive ion etches, deep reactive ion etches, etc. Preferred photolithography steps include exposure to ultraviolet or x-ray light sources, or other.

As is apparent from the figure, the substrate 122 provides the base layer upon which all other layers are formed. In one embodiment, it comprises a silicon wafer of p-type, 100 orientation, having a resistivity of 5-20 ohm/cm. Its beginning thickness ranges about 200 to 800 microns, with more preferred sizes being 525+/−20 microns, 625+/−20 microns, 625+/−15 microns, or other. Its diameter is 100+/−0.50 mm, 125+/−0.50 mm, 150+/−0.50 mm, or other.

Adjacent the substrate is a thermal barrier layer 142. It includes a pure silicon oxide ($SiO_2$) composition or one mixed with glass such as BPSG, PSG or PSOG. It can even include silicon nitride. In a particular ultra-low energy design, the barrier consists of BPSG in a thickness of about 7800 Angstroms, followed by silox in a thickness of about 6000 Angstroms, followed by silicon nitride in a thickness of about 500 Angstroms. Of course, the barrier can be grown on the substrate as well as being deposited, or include aspects of both.

Adjacent the barrier layer is the insulative layer 132. It includes methyl silesquioxane (MSQ) in a thickness, of about 5000-6000 Angstroms or more. As with other insulators, its atomic level structure is very porous and typically defines thermal conductivity between 0.15 and 0.45 W/m-K. Other materials include, but are not limited to, Hydrogen Silsesquioxane (HSQ), fluorosilicate glass (FSG), or the like.

Directly adjacent the insulative layer 132, in the area of the heater element 117, is a cap 146 that serves to prevent ion mobility between the resistor 126 and insulative layers during use. Not only does it inhibit migration of metal ions from the heater element to the insulative layer, but also migration of oxygen from the insulative layer into the resistor layer. Its composition can vary, but silicon nitride (SiN) has been found very useful in a thickness of about 2000 Angstroms or less. Appreciating the moderate conductivity of SiN, its thickness is made relatively thin and 500-1000 Angstroms is a more representative range. In other designs, silicon carbide, silicon oxide and dielectric materials are anticipated as serving the same function of capping the insulative layer. Similarly, plasma treatments of $H_2$, $NH_3$, $N_2O$ and $O_2$ are contemplated alone or in combination with the cap layer for passivating the surface of the insulative layer and sealing off the substantial pores of the insulator.

Subsequent to the cap layer, traditional layers include the resistor layer 126, conductor layer 159, 160 and any overcoat layers 130. The resistor typifies any of a variety of compositions, such as hafnium, Hf, tantalum, Ta, titanium, Ti, tungsten, W, hafnium-diboride, $HfB_2$, Tantalum-nitride, $Ta_2N$, TaAl(N,O), TaAlSi, TaSiC, Ta/TaAl layered resistor, Ti(N,O) and WSi(O). In a particular ultra-low energy design of the invention, TaAlN is used in a thickness of about 350 Angstroms.

Overlying the resistor layer is the conductor layer. It includes both anode and cathode portions that define the heater element 117. Its composition is representatively aluminum in a thickness of about 11,000 Angstroms. Other designs envision thicknesses from about 4,000 to 15,000 Angstroms with materials selected from copper, gold, silver, and alloys thereof. The selection requirements relate to cost and electrical conduction, to name a few.

Lastly, the coating layers 130 reside above the conductor layer and the resistor layer. They serve traditional notions of passivation and cavitation protection. They can be single or multiple layers. In one embodiment, the bottom coating layer is SiN in a thickness of about 1500 Angstroms, while the top coating layer is Ta in a thickness of about 500 Angstroms.

Figure 4:
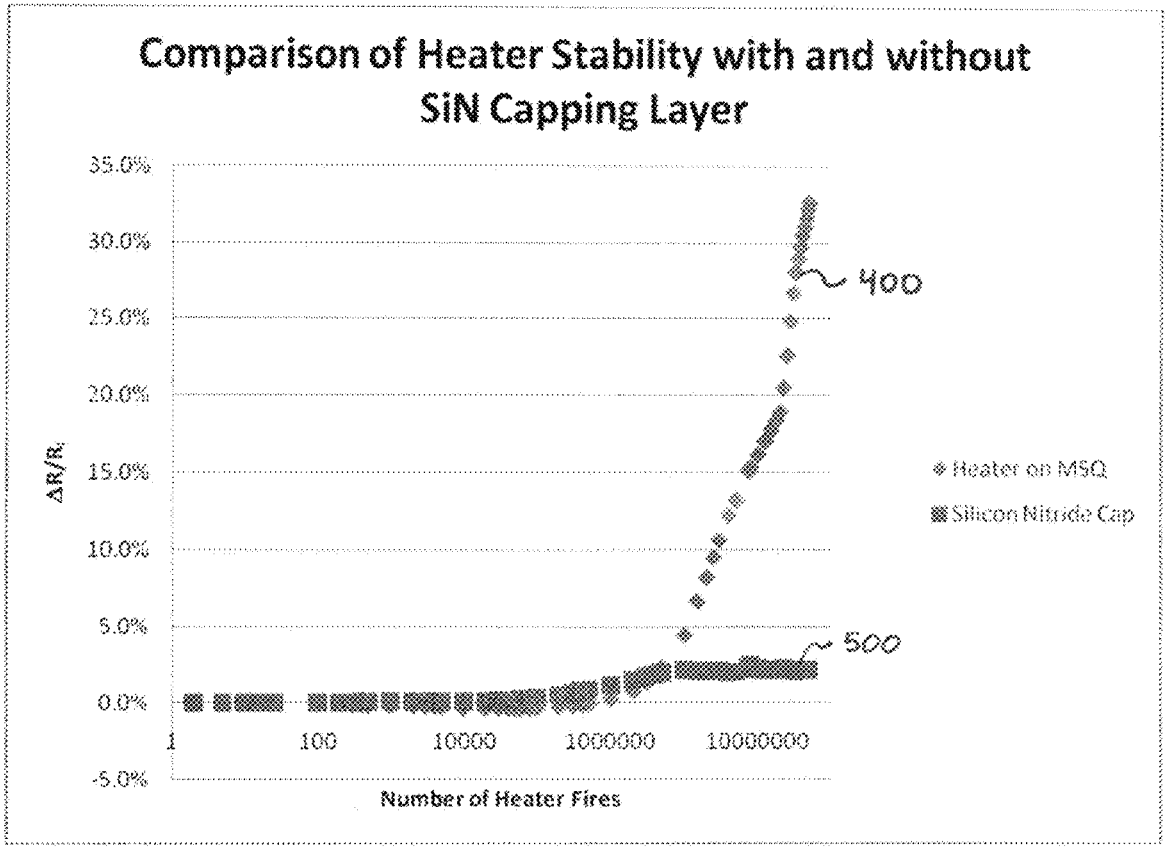
FIGS. 4 and 5 are graphs in accordance with the teachings of the present invention illustrating features of the capping layer over the insulative layer.

With reference to FIG. 4, it has been learned that a SiN layer serving as a cap to an MSQ insulative layer has achieved great resistance stability of a heater element over a lifetime of firing. At curve 500, a 0 to 5.0% $\Delta R/R_t$ has been maintained for fires exceeding ten million, but prior art designs having no cap (curve 400) have tended toward instability at around one million fires. For at least this reason, the cap shows advantage over known designs of micro-fluid ejection heads. (The data was drawn from "dry-fire" (no ink) experimentation, including a cap of 500 Angstroms in comparison to a resistor layer in direct contact with an MSQ conductive layer.)

Figure 5:
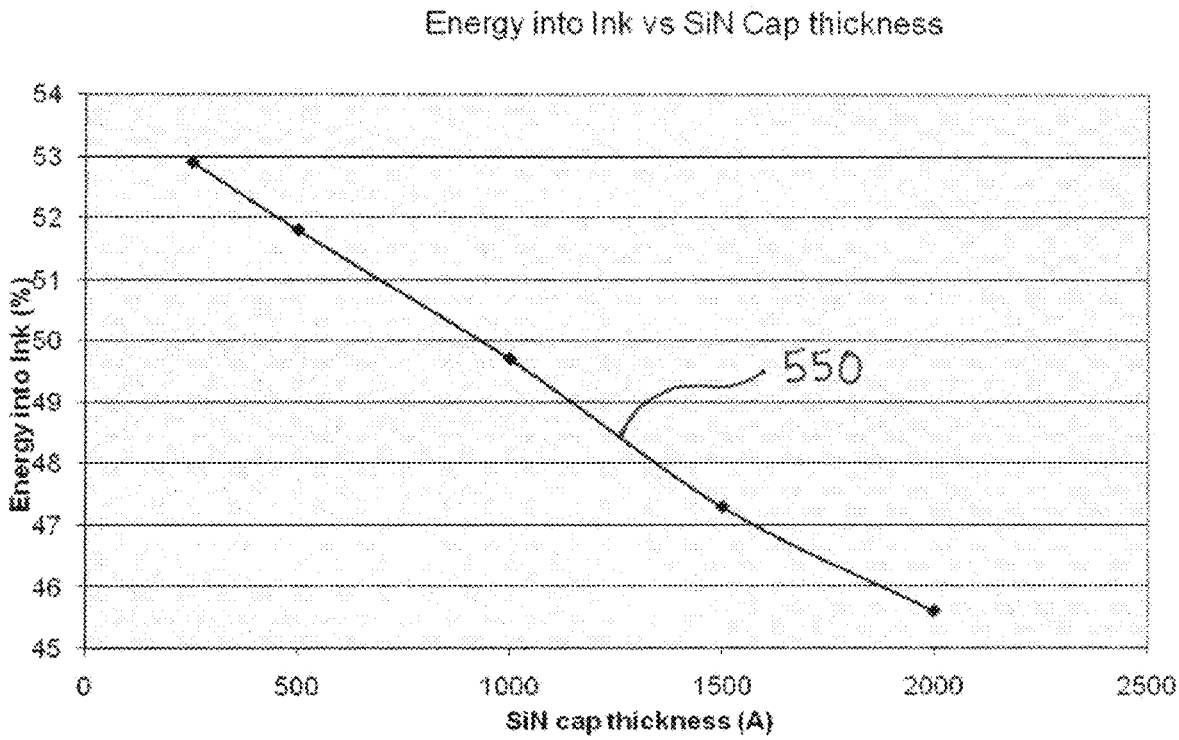

With reference to FIG. 5, predictive modeling of this same SiN cap reveals a curve 550 showing an increase in energy directed into jetted ink as the thickness of the SiN cap decreases. In other words, the smaller the thickness of the SiN cap, the more that energy is available to the ink, thereby improving thermal efficiency. As is seen, preferred thickness exist below about 2000 Angstroms, with more preferred ranges existing at 250-1000 Angstroms thick.

Figure 6A:
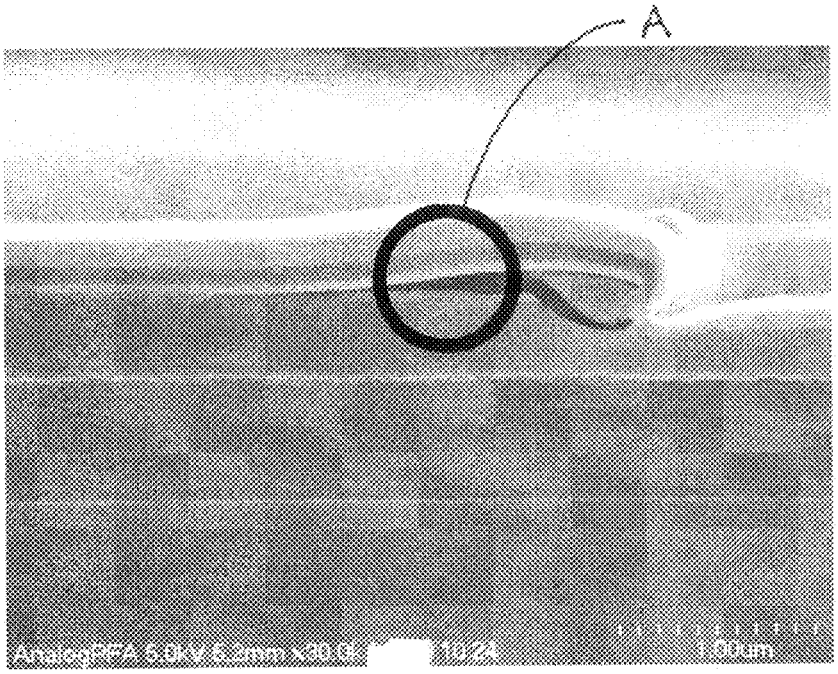
FIGS. 6A and 6B are images from a scanning electron microscope (SEM) in accordance with the teachings of the present invention showing improved adhesion between a resistor layer and the insulative layer.
Figure 6B:
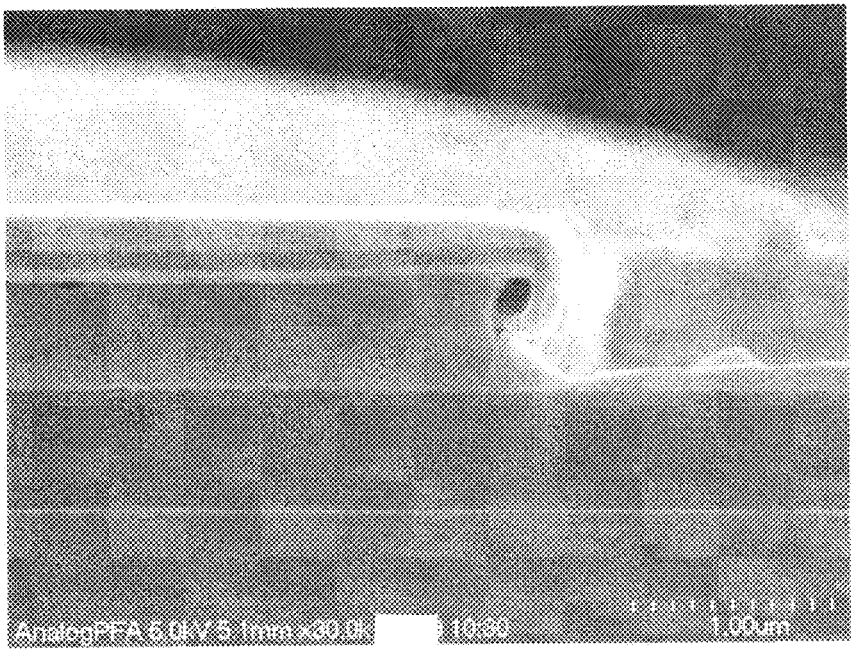

In addition, SiN as a cap to an MSQ insulative layer has revealed improved adhesion between the MSQ and the resistor layer. With reference to FIG. 6A, SEM images reveal significant delamination between the resistor layer and the MSQ insulative capping layer at Area A when the two are in direct contact. In contrast, this delamination is not seen when the SiN cap caps the MSQ layer in FIG. 6B. (The data was drawn from "dry-fire" experimentation up to 500 million fires, including a cap of 500 Angstroms in comparison to a resistor layer in direct contact with an MSQ conductive layer.)

Figure 7A:
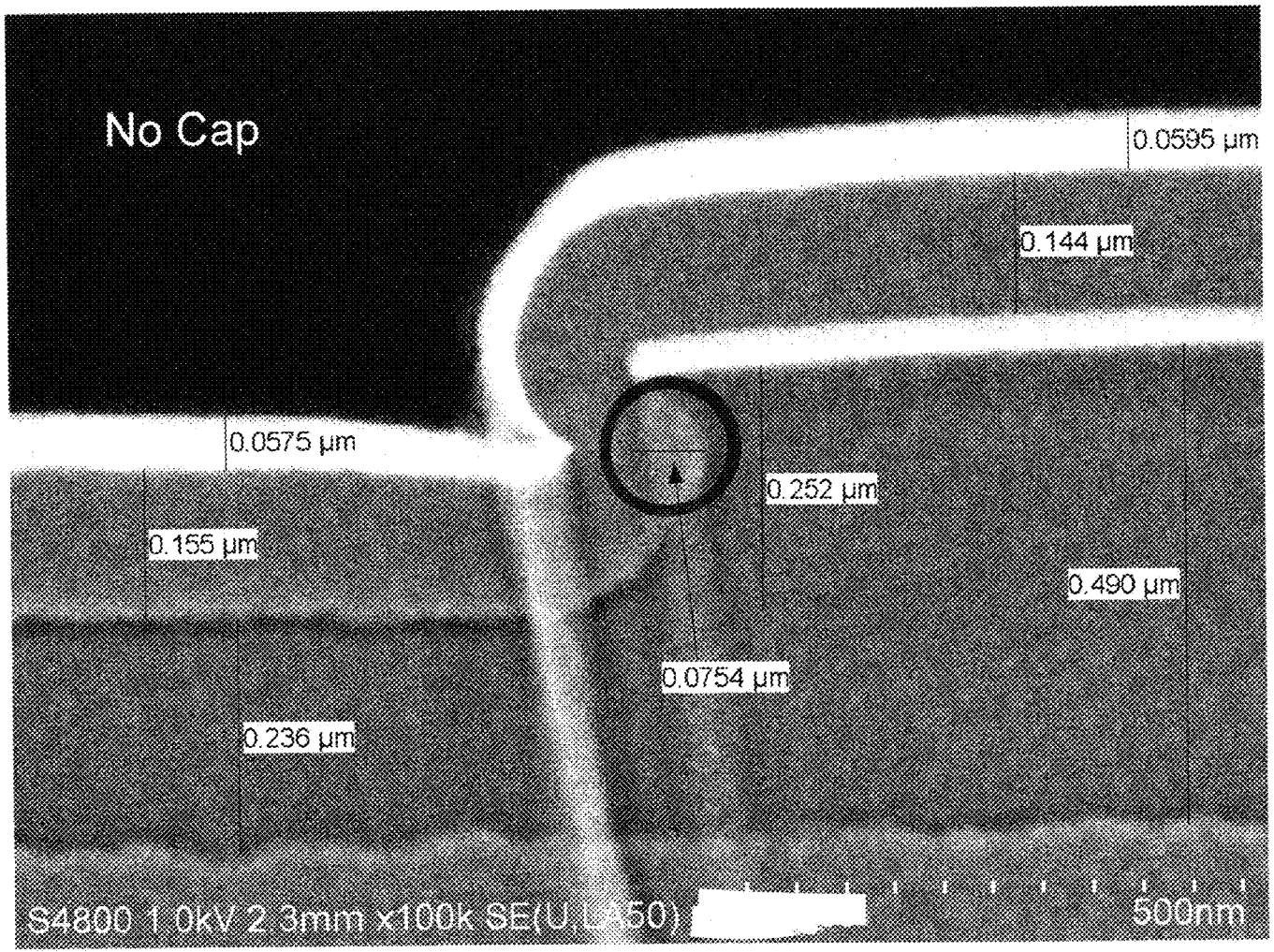
FIGS. 7A, 7B and 7C are images from a scanning electron microscope (SEM) in accordance with the teachings of the present invention showing relative comparisons of a resistive heater as a function of capping layer thickness.
Figure 7B:
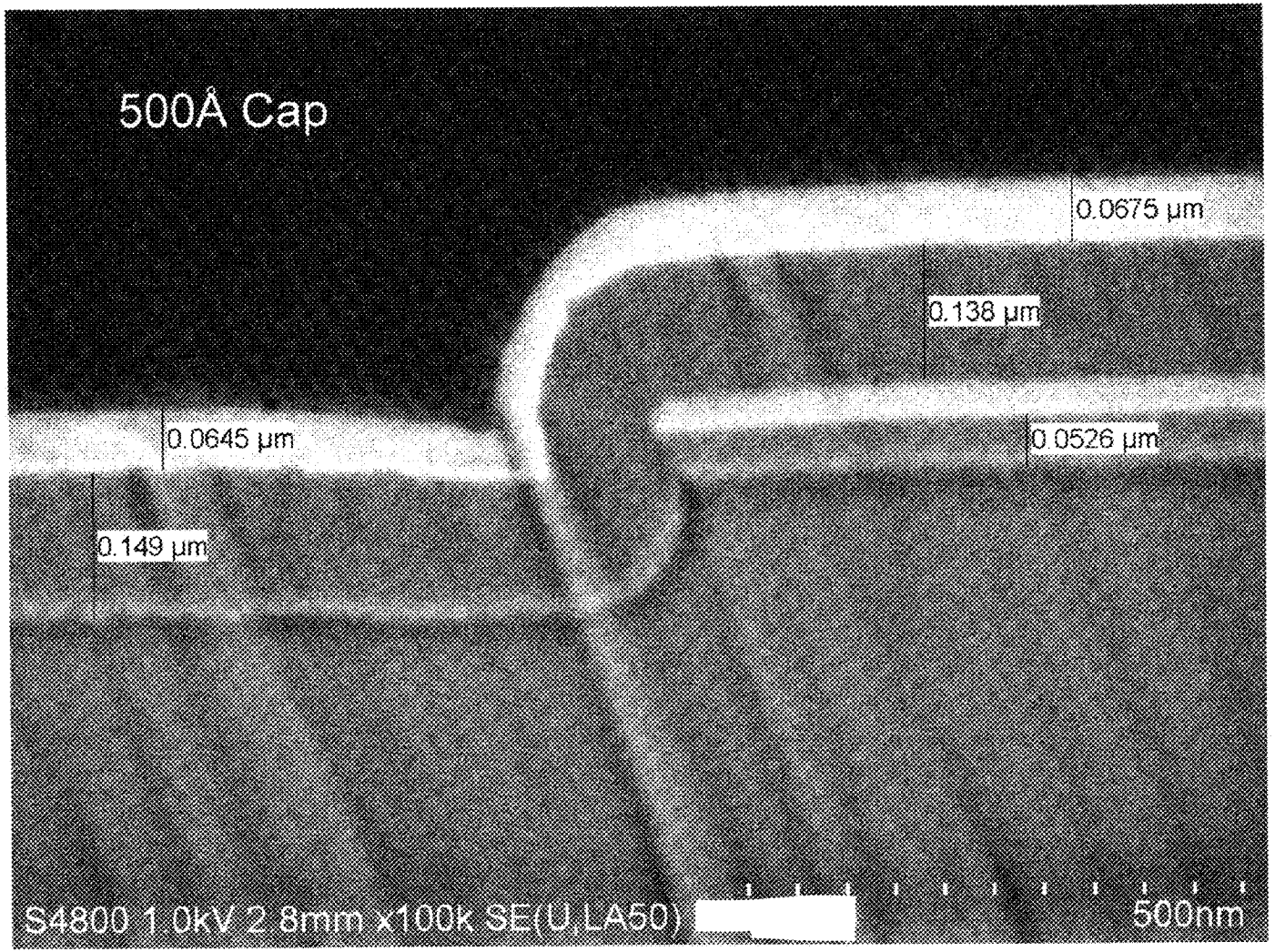
Figure 7C:
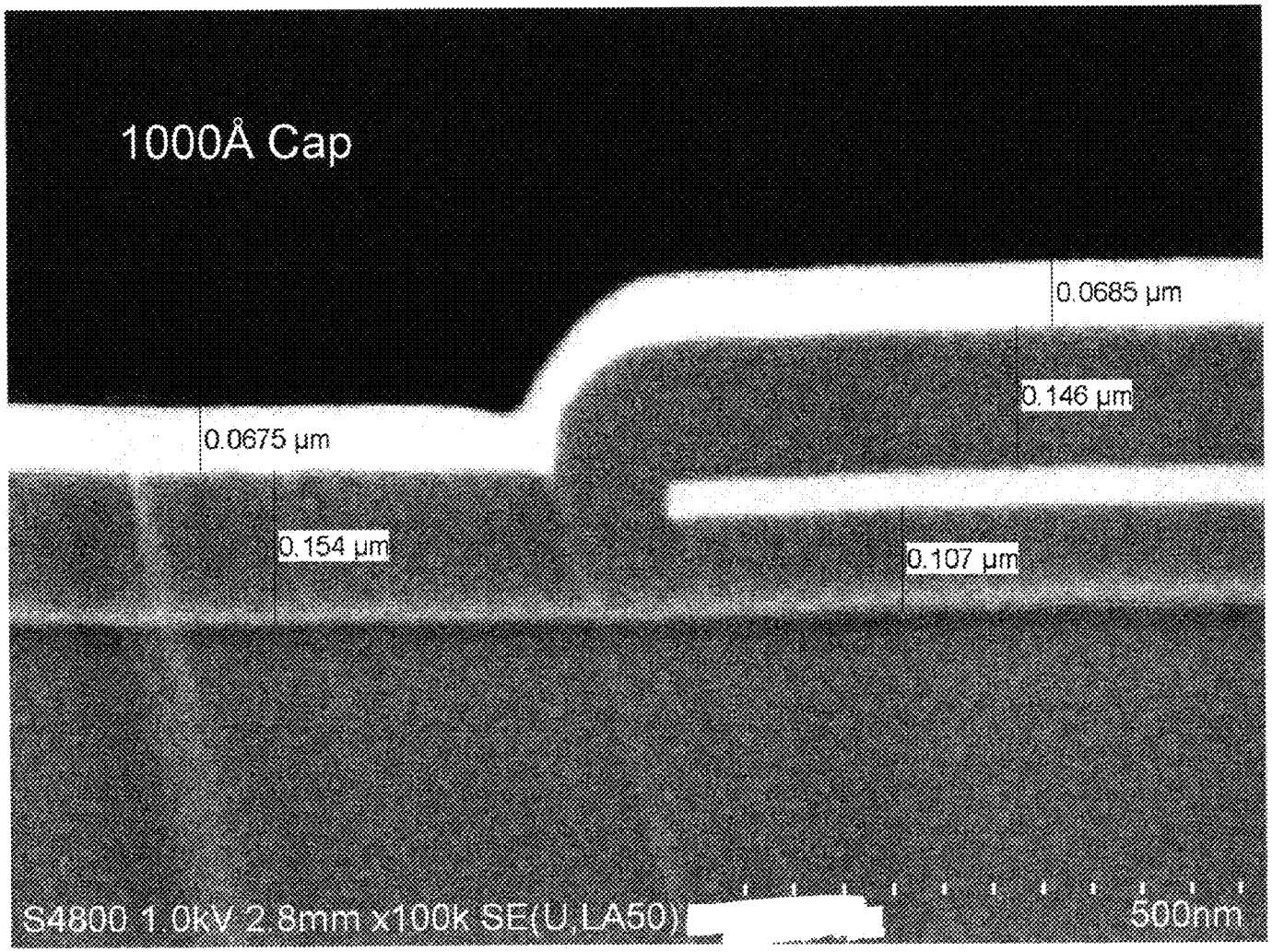

Similarly, FIGS. 7A, 7B and 7C comparatively reveal improvement in the "undercut" of the heater element as a function of cap thickness. In FIG. 7A, the undercut is severe in the Circle area where the ejection head has "no cap." In each of FIGS. 7B and 7C, the undercut is significantly improved with heads having SiN cap thicknesses of 500 and 1000 Angstroms, respectively.

The foregoing has been presented for purposes of illustrating the various aspects of the invention. It is not intended to be exhaustive or to limit the claims. Rather, it is chosen to provide the best illustration of the principles of the invention and its practical application to enable one of ordinary skill in the art to utilize the invention, including its various modifications that naturally follow. All such modifications and variations are contemplated within the scope of the invention as determined by the appended claims.

The invention claimed is:

1. A micro-fluid ejection head for a micro-fluid ejection device, comprising:
- a substrate;
- a thermal barrier layer directly on the substrate;
- a resistor layer on the substrate that is energized to eject fluid from a resistive heater element during use;
- an insulative layer directly on the thermal barrier layer and underlying the resistor layer in an area defining the resistive heater element, the insulative layer being relatively thick at about 5000 Angstroms or more; and
- a capping layer directly on the insulative layer and directly under the resistor layer in the area defining the resistive heater element to substantially prevent ion mobility between the resistor and insulative layers during use, the capping layer being relatively thin compared to the insulative layer at about 2000 Angstroms or less.

2. The ejection head of claim 1, wherein the capping layer is silicon nitride.

3. The ejection head of claim 1, further including a conductor layer on the resistor layer having an anode and cathode defining the resistive heater element.

4. The ejection head of claim 1, wherein the insulative layer is methyl silesquioxane (MSQ).

5. A micro-fluid ejection head, comprising:
- a substrate;
- a thermal barrier layer directly on the substrate;
- a TaAlN resistor layer on a substrate that is energized to eject fluid from a resistive heater during use;
- a methyl silesquioxane (MSQ) insulative layer directly on the thermal barrier layer and underlying the resistor layer; and
- a silicon nitride (SiN) capping layer directly on the MSQ insulative layer and directly under the TaAlN resistor layer in an area defining the resistive heater, the SiN capping layer being about 1000 Angstroms or less, the MSQ insulative layer being about 5000 Angstroms or more, and the TaAlN resistor layer being about 350 Angstroms.

6. The ejection head of claim 5, further including a coating layer overlying the TaAlN resistor layer in the area defining the resistive heater.

7. The ejection head of claim 5, wherein the SiN capping layer is about 500 Angstroms or less.

* * * * *